US006336830B1

(12) United States Patent
Lee

(10) Patent No.: US 6,336,830 B1
(45) Date of Patent: Jan. 8, 2002

(54) MODULAR CONNECTOR ASSEMBLY FOR AN ELECTRONIC APPLIANCE

(75) Inventor: Chuan-Yuan Lee, Taipei (TW)

(73) Assignee: Compal Electronics, Inc., Taipei (TW)

( * ) Notice: Subject to any disclaimer, the term of this patent is extended or adjusted under 35 U.S.C. 154(b) by 0 days.

(21) Appl. No.: 09/636,808

(22) Filed: Aug. 10, 2000

(51) Int. Cl.[7] ..... H01R 24/00
(52) U.S. Cl. ..... 439/676; 439/76.1; 439/395
(58) Field of Search ..... 439/676, 941, 439/344, 76.1, 395, 492

(56) References Cited

U.S. PATENT DOCUMENTS

| | | | | |
|---|---|---|---|---|
| 5,997,358 A | * | 12/1999 | Adriaenssens et al. | 439/676 |
| 6,102,722 A | * | 8/2000 | Arnett | 439/676 |
| 6,102,741 A | * | 8/2000 | Boutros et al. | 439/676 |
| 6,179,667 B1 | * | 1/2001 | Espenshade et al. | 439/676 |
| 6,183,306 B1 | * | 2/2001 | Caveney | 439/676 |

* cited by examiner

*Primary Examiner*—Hien Vu
(74) *Attorney, Agent, or Firm*—Pillsbury Winthrop LLP

(57) ABSTRACT

A modular connector assembly includes an insulating connector housing which is adapted to be mounted on a main circuit board of an electronic appliance that has an electronic component on the main circuit board. The connector housing is formed with a connector mating hole, and has a partition wall for defining a front chamber communicated with the connector mating hole, and a rear chamber. The partition wall cooperates with a bottom wall of the connector housing to define a channel for communicating the front and rear chambers. The bottom wall is formed with a plurality of terminal retaining grooves within the connector housing. A plurality of contact terminals have elongated main portions extending through the channel and retained in the retaining grooves. Each contact terminal has a resilient contact portion disposed in the front chamber and a cable connecting portion disposed in the rear chamber. A ribbon cable extends into the rear chamber, and has one end connected electrically to the cable connecting portions of the contact terminals and the other end adapted to be connected to the electronic component.

4 Claims, 4 Drawing Sheets

MODULAR CONNECTOR ASSEMBLY FOR AN ELECTRONIC APPLIANCE

BACKGROUND OF THE INVENTION

1. Field of the Invention

The present invention relates to a modular connector assembly for an electronic appliance, more particularly to a modular connector assembly which can be connected electrically to an electronic component of the electronic appliance without the need for forming a printed circuit on a main circuit board of the electronic appliance.

2. Description of the Related Art

FIG. 1 illustrates the connection between a conventional RJ11/RJ45 electrical connector 3 and a mini peripheral component interconnect (mini PCI) 2 provided on a main circuit board 1. The electrical connector 3 is suitable for mating with a complementary electrical connector 4, and is mounted on the main circuit board 1 adjacent to an edge portion of the latter by means of known soldering or surface mounting (SMT) techniques. The electrical connector 3 and the mini PCI 2 have contact terminals 31, 21 inserted through the main circuit board 1. The main circuit board 1 is provided with a printed circuit 11 for interconnecting electrically the contact terminals 21, 31 of the mini PCI 2 and the electrical connector 3.

However, to form the printed circuit 11, a layout of the circuit should be designed beforehand, and the main circuit board 1 should undergo several treatment steps which include, for example, chemical etching. The contact terminals 21, 31 of the mini PCI 2 and the electrical connector 3 are subsequently welded to the main circuit board 1 to ensure electrical connection between the contact terminals 21, 31 and the printed circuit 11. These complicate the manufacturing process of the electronic appliance. Moreover, as the printed circuit 11 is exposed from the circuit board 1, the printed circuit 11 may possibly cause static discharge and electromagnetic interference within the electronic appliance to adversely affect the functions of other electronic components in the electronic appliance.

SUMMARY OF THE INVENTION

Therefore, the main object of the present invention is to provide a modular connector assembly which can be connected electrically to an electronic component of an electronic appliance without the need for forming a printed circuit on a main circuit board of the electronic appliance.

Accordingly, the modular connector assembly of the present invention is adapted for use in an electronic appliance having an electronic component on a main circuit board, and includes a connector housing, a plurality of contact terminals, and a ribbon cable. The connector housing is made of an electrically insulating material, and is adapted to be mounted on the main circuit board. The connector housing has a front end formed with a connector mating hole, a rear end opposite to the front end, parallel top and bottom walls extending between the front and rear ends, and a vertical partition wall extending downwardly from the top wall toward the bottom wall so as to define within the connector housing a front chamber proximate to the front end and communicated with the connector mating hole, and a rear chamber proximate to the rear end. The partition wall has a lower end which is spaced apart from the bottom wall and which cooperates with the bottom wall to define a channel therebetween for communicating the front and rear chambers. The bottom wall is formed with a plurality of terminal retaining grooves within the connector housing. Each of the contact terminals has an elongated main portion extending through the channel and retained in a respective one of the retaining grooves and having front and rear ends, a resilient contact portion disposed in the front chamber and extending from the front end of the main portion toward the partition wall, and a cable connecting portion extending from the rear end of the main portion and disposed in the rear chamber. The ribbon cable extends into the rear chamber, and has one end connected electrically to the cable connecting portions of the contact terminals and the other end adapted to be connected to the electronic component on the circuit board.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
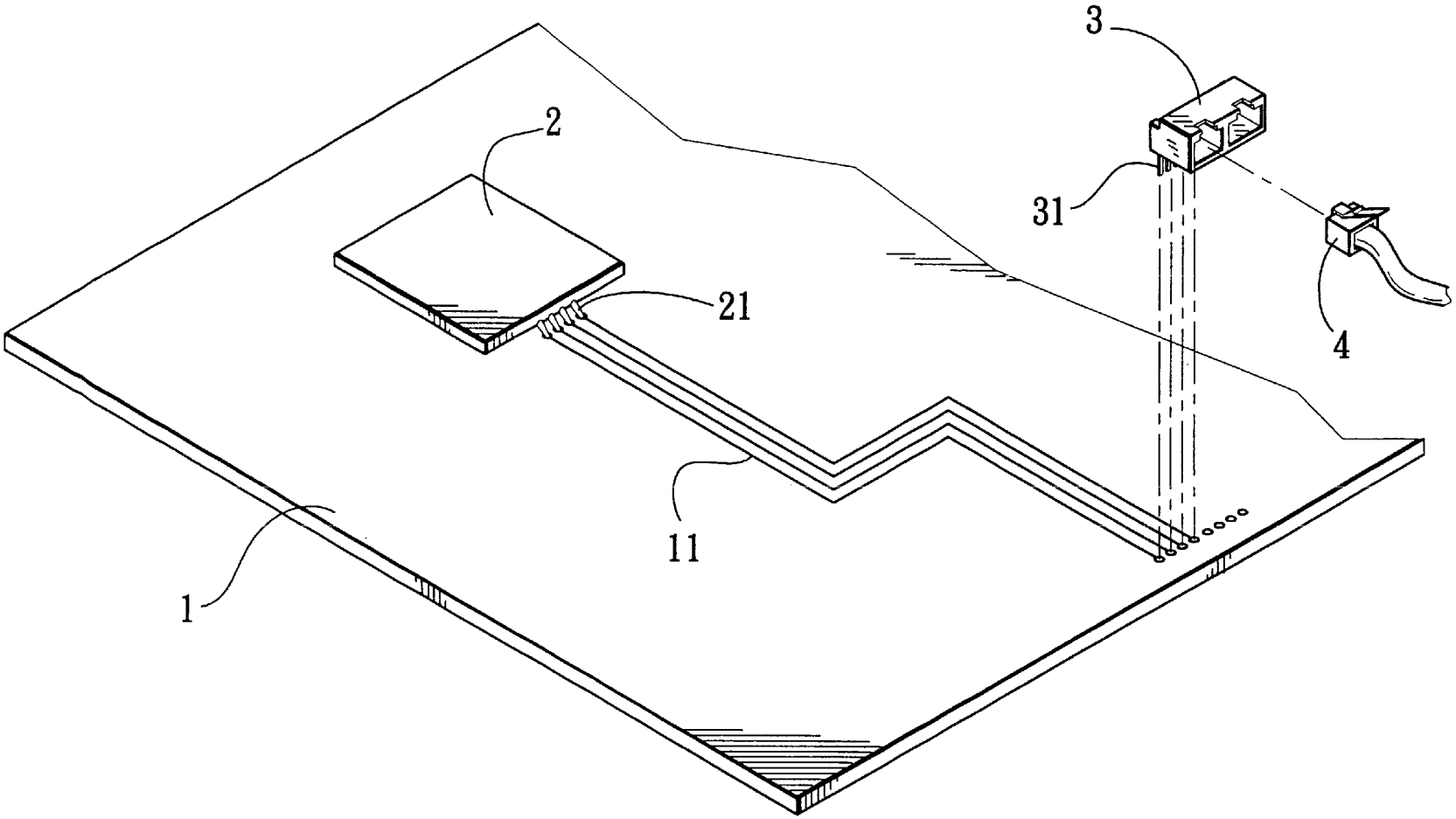
FIG. 1 PRIOR ART
FIG. 1 is a partly exploded perspective view illustrating a conventional electrical connector when mounted on a main circuit board of an electronic appliance.
Figure 2:
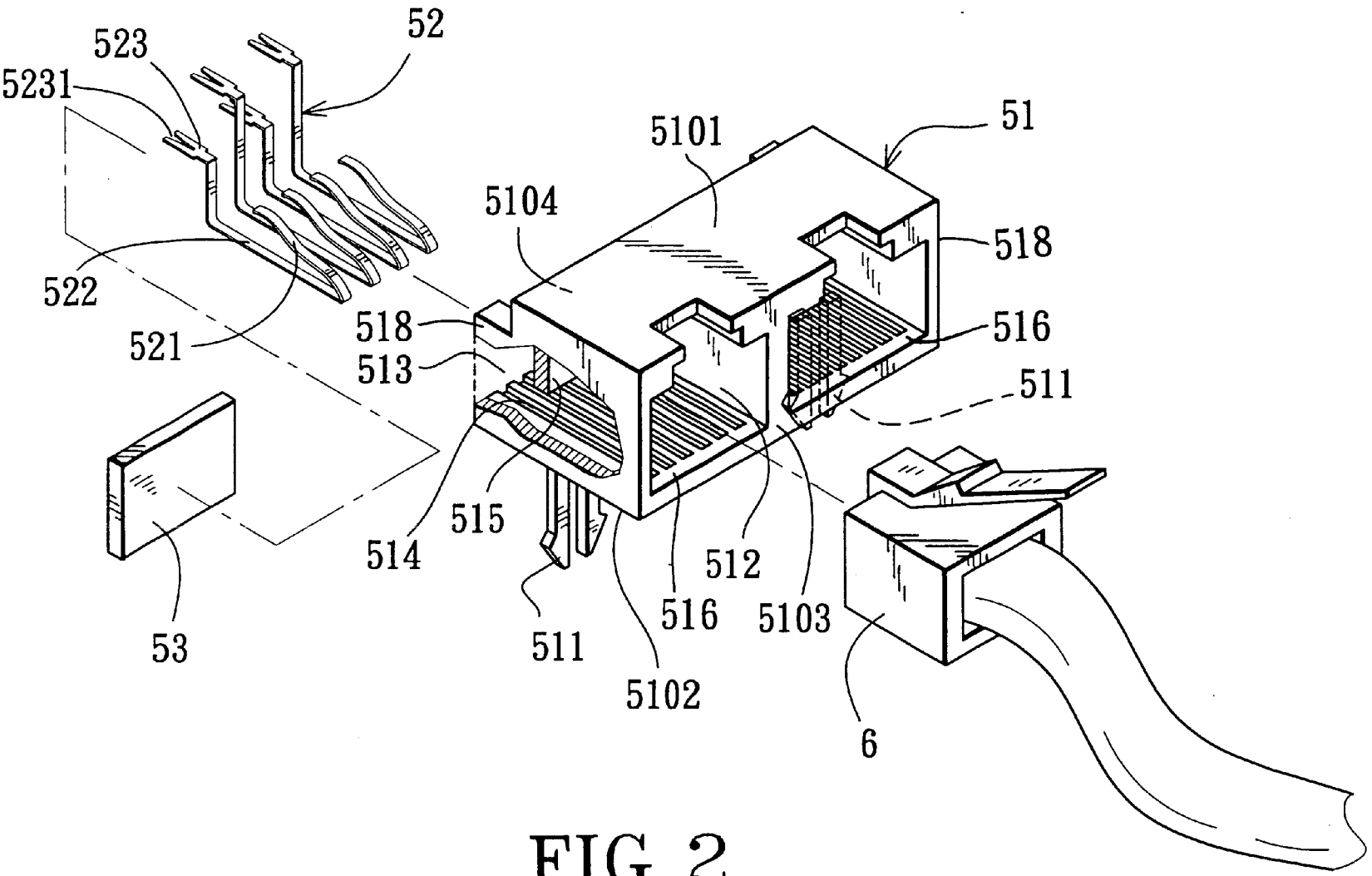
FIG. 2 is an exploded perspective view of a preferred embodiment of a modular connector assembly of the present invention.
Figure 3:
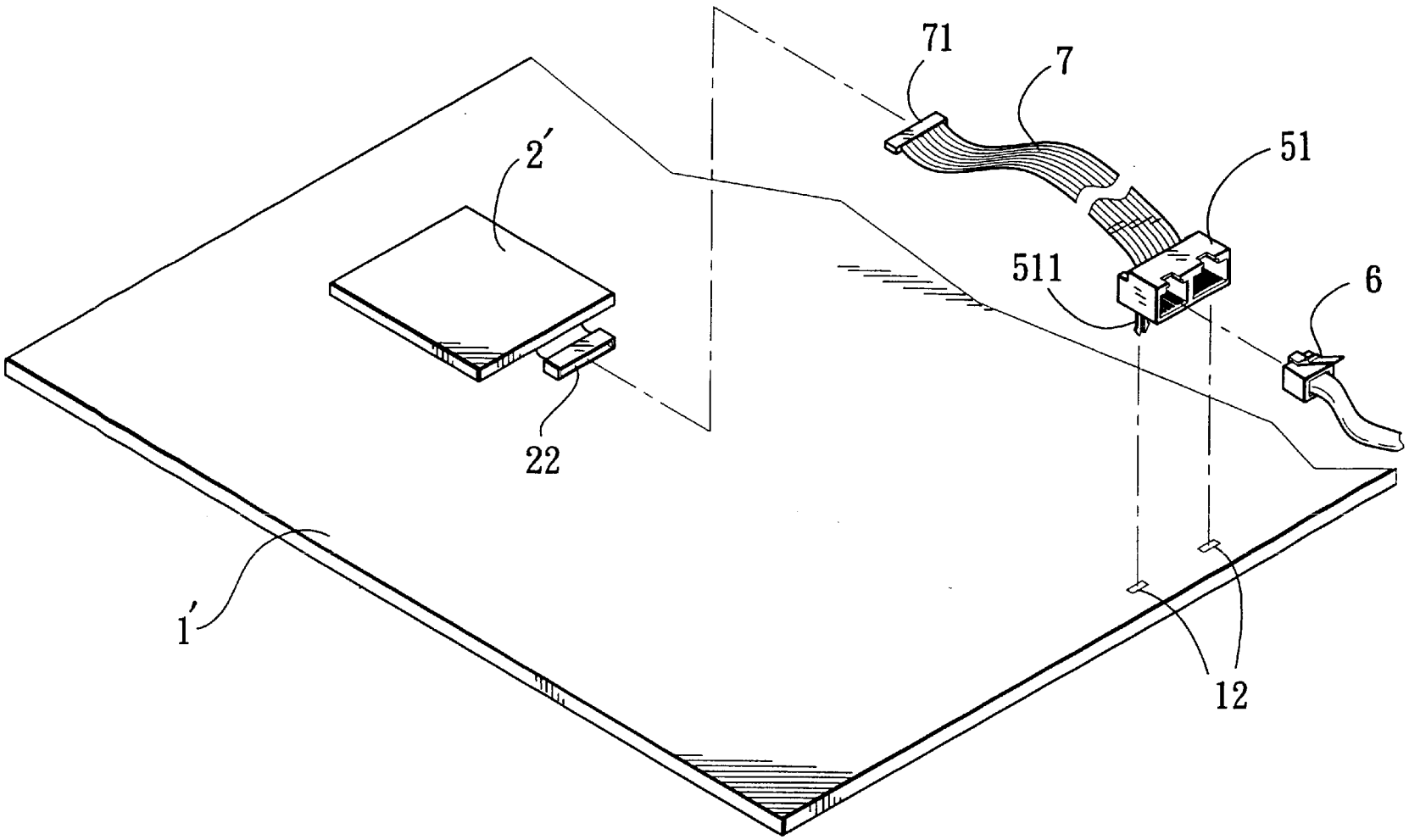
FIG. 3 illustrates the preferred embodiment when mounted on a main circuit board of an electronic appliance.
Figure 4:
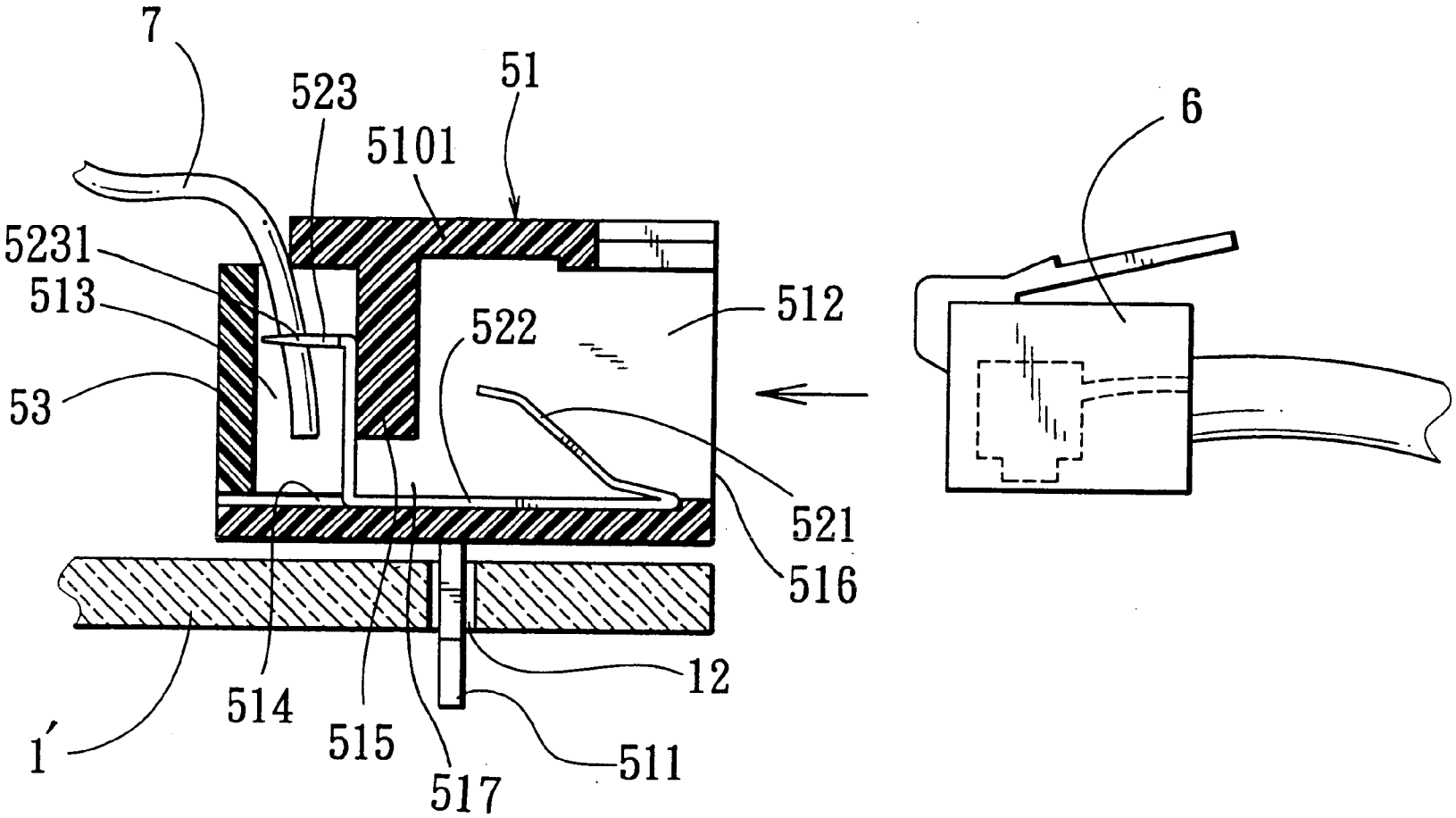
FIG. 4 is a cross-sectional view of the preferred embodiment when mounted on the main circuit board.

Referring to FIGS. 2 to 4, the preferred embodiment of the modular connector assembly of the present invention is shown to include a connector housing 51, a plurality of contact terminals 52, a cover plate 53, and a ribbon cable 7.

The connector housing 51 is formed as a housing of an RJ11/RJ45 electrical connector, and has left and right connector mating portions which are formed integrally from an electrically insulating material. The connector housing 51 has a front end 5103, a rear end 5104, and parallel top and bottom wall 5101, 5102 between the front and rear ends 5103, 5104. The front end 5103 is formed with a connector mating hole 516 in each of the connector mating portions. A vertical partition wall 515 extends downwardly from the top wall 5101 toward the bottom wall 5102 so as to define, within each of the connector mating portions of the housing 51, a front chamber 512 proximate to the front end 5103 and a rear chamber 513 proximate to the rear end 5104. The front chamber 512 is communicated with the respective connector mating hole 516, and is adapted for receiving a complementary electrical connector 6 that is plugged into the connector mating hole 516. The partition wall 515 has a lower end which is spaced apart from the bottom wall 5102 and which cooperates with the bottom wall 5102 to define a channel 517 therebetween for communicating the front and rear chambers 512, 513. The bottom wall 5102 has a top side formed with a plurality of parallel and elongated terminal retaining grooves 514 which extend from the rear end 5104 toward the front end 5103. The connector housing 51 is further formed with two pairs of anchoring legs 511 which extend downwardly from the bottom wall 5102 and which has hooked distal ends.

Each of the contact terminals 52 is formed by bending an elongated strip, and has an elongated main portion 522 with front and rear ends, a resilient contact portion 521 extending rearwardly from the front end of the main portion 522, and a cable connecting portion 523 extending upwardly from the rear end of the main portion 522. The main portion 522 extends through the channel 517, and is retained in a respective one of the terminal retaining grooves 514 within the connector housing 51. The resilient contact portion 521 is disposed in the front chamber 512, and extends toward the partition wall 515. The cable connecting portion 523 is disposed in the rear chamber 513, and has a forked end 5231 which extends toward the rear end 5104 of the connector housing 51.

The ribbon cable 7 includes a plurality of conductive wires, each of which has an insulating sheath. The ribbon cable 7 has a first end extending into the rear chamber 513 via the rear end 5104 of the connector housing 51. The forked end 5231 of the cable connecting portion 523 of each of the contact terminals 52 pierces through the insulating sheath of a respective one of the conductive wires of the ribbon cable 7 for connecting electrically with the ribbon cable 7. The ribbon cable 7 further has an opposite second end provided with a cable connector 71.

The cover plate 53 is disposed vertically at the rear end 5104 of the connector housing 51, and is retained fittingly between left and right side walls 518 of the connector housing 51 for covering an open rear end of the rear chamber 513 and for concealing the forked ends 5231 of the cable connecting portions 523 of the contact terminals 52. The cable 7 is clamped and positioned between the cover plate 53 and a rear edge of the top wall 5101. The contact terminals 52 are shielded by the cover plate 53 to minimize electromagnetic interference.

FIGS. 3 and 4 illustrate the modular connector assembly of the present embodiment when applied to a main circuit board 1' of an electronic appliance. The main circuit board 1' is provided with an electronic component 2', such as a mini Peripheral Component Interconnect, having a socket connector 22. The connector housing 51 is adapted to be mounted on the main circuit board 1' by inserting the anchoring legs 511 into a pair of anchoring holes 12 formed in the main circuit board 1' so as to engage the anchoring holes 12. The cable connector 71 of the ribbon cable 7 is then mated with the socket connector 22 of the electronic component 2' to establish electrical connection therewith. In this manner, the main circuit board 1' need not be formed with a printed circuit to establish connection between the connector assembly and the electronic component 2', thereby avoiding the occurrence of static discharge and electromagnetic interference that are commonly encountered in the aforesaid prior art.

In other embodiments, the connector housing 51 may be formed with screw holes so as to be adapted for mounting on a side wall of a housing of the electronic appliance by means of screw fasteners.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A modular connector assembly for an electronic appliance having an electronic component on a main circuit board, comprising:

a connector housing made of an electrically insulating material and adapted to be mounted on said main circuit board, said connector housing having a front end, a rear end opposite to the front end, and parallel top and bottom walls extending between the front and rear ends, said connector housing further having:

left and right connector mating portions which are connected integrally with each other, each of said connector mating portions being formed with a connector mating hole at said front end of said connector housing;

a vertical partition wall that extends downwardly from said top wall toward said bottom wall so as to define, within the respective connector mating portions, a front chamber proximate to said front end and in communication with said connector mating hole; and a rear chamber proximate to said rear end of said connector housing, said vertical partition wall having a lower end spaced apart from said bottom wall and cooperating with said bottom wall to define a channel therebetween for communication between said front and rear chambers of the respective connector mating portions, said bottom wall being formed with a plurality of terminal retaining grooves in each of said connector mating portions of said connector housing, said connector housing being further formed with an anchoring leg which extends downwardly from said bottom wall and which is adapted for engaging the circuit board;

a plurality of contact terminals, each of which has an elongated main portion which extends through said channel, that is retained in a respective one of said retaining grooves in said left and right connector mating portions and that has front and rear ends and, a resilient contact portion disposed in said front chamber of one of said left and right connector mating portions and extending from said front end of said main portion toward said vertical partition wall of one of said left and right connector mating portions, and a cable connecting portion extending from said rear end of said main portion and disposed in said rear chamber of one of said left and right connector mating portions, said cable connecting portion having a forked end; and a ribbon cable having a first end extending into said rear chambers of said left and right connector mating portions, said ribbon cable including a plurality of conductive wires, each of said conductive wires having an insulating sheath, said forked end of said cable connecting portion of each of said contact terminals piercing through said insulating sheath of a respective one of said conductive wires for connecting electrically with said ribbon cable, said ribbon cable further having a second end opposite to said first end and provided with a cable connector adapted to be connected to the electronic component on the circuit board.

2. The modular connector assembly as claimed in claim 1, wherein one of said connector mating portions of said connector housing is of an RJ11 type, and the other of said connector mating portions of said connector housing is of an RJ45 type.

3. The modular connector assembly as claimed in claim 1, wherein said ribbon cable includes a plurality of conductive wires, each of which has an insulating sheath, said cable connecting portion of each of said contact terminals having a forked end which pieces through said insulating sheath of a respective one of said conductive wires for connecting electrically with said ribbon cable.

4. The modular connector assembly as claimed in claim 1, wherein the other end of said ribbon cable is provided with a cable connector adapted to be connected to the electronic component on the circuit board.

* * * * *